US005156428A

United States Patent [19]

Wright

[11] Patent Number: 5,156,428

[45] Date of Patent: Oct. 20, 1992

[54] JANITORIAL BRUSH GRASPING DEVICE

[76] Inventor: Alexander Wright, 1063 Westwoor Dr., West Chester, Pa. 19382

[21] Appl. No.: 764,768

[22] Filed: Sep. 24, 1991

[51] Int. Cl.[5] ..... A47L 25/00; B25J 1/04

[52] U.S. Cl. ..... 294/19.1; 294/24; 15/105

[58] Field of Search ..... 294/1.4, 2, 19.1, 24, 294/100; 15/105, 106, 116.1, 117

[56] References Cited

U.S. PATENT DOCUMENTS

| | | | |
|---|---|---|---|
| 394,550 | 12/1888 | Ansley | 294/19.1 X |
| 1,927,528 | 9/1933 | Nilsson | 294/19.1 X |
| 2,739,330 | 3/1956 | Hitchcock | 294/26 X |
| 3,093,402 | 6/1963 | Sisson | 294/19.1 |
| 3,101,500 | 8/1963 | Paolantonio | 294/19.1 X |
| 4,222,597 | 9/1980 | Willis | 294/1.4 |
| 4,466,647 | 8/1984 | Spevak | 294/100 X |
| 4,575,143 | 3/1986 | Nast | 294/19.1 X |
| 4,819,977 | 4/1989 | Cooper | 294/1.4 |

FOREIGN PATENT DOCUMENTS

| | | | |
|---|---|---|---|
| 628792 | 3/1982 | Switzerland | 294/100 |

*Primary Examiner*—Margaret A. Focarino

*Assistant Examiner*—Dean J. Kramer

*Attorney, Agent, or Firm*—Shlesinger Arkwright & Garvey

[57] ABSTRACT

A janitorial implement for cleaning toilets, urinals and the like, and having a device for grasping soiled objects, the brush comprising a hollow handle device for operatively handling the brush, the handle device having an outer side wall and a hollow interior and having a slot to its outer side wall to the hollow interior, the handle device having a first end and a second end a pair of cooperating grasping device extending from the first end the grasping device being integrally connected to a handle extension device, the handle extension device being slidably mounted within the hollow interior an operating device connected to the extension device and extending through the slot for moving the extension device into an out of the hollow handle device spreading device operatively positioned at the second end, the spreading device including a spreader bar for enlarging the distance between the pair of grasping device when the extension device is moved outwardly from the hollow interior the spreading device includes scrubbing device connected thereto.

17 Claims, 2 Drawing Sheets

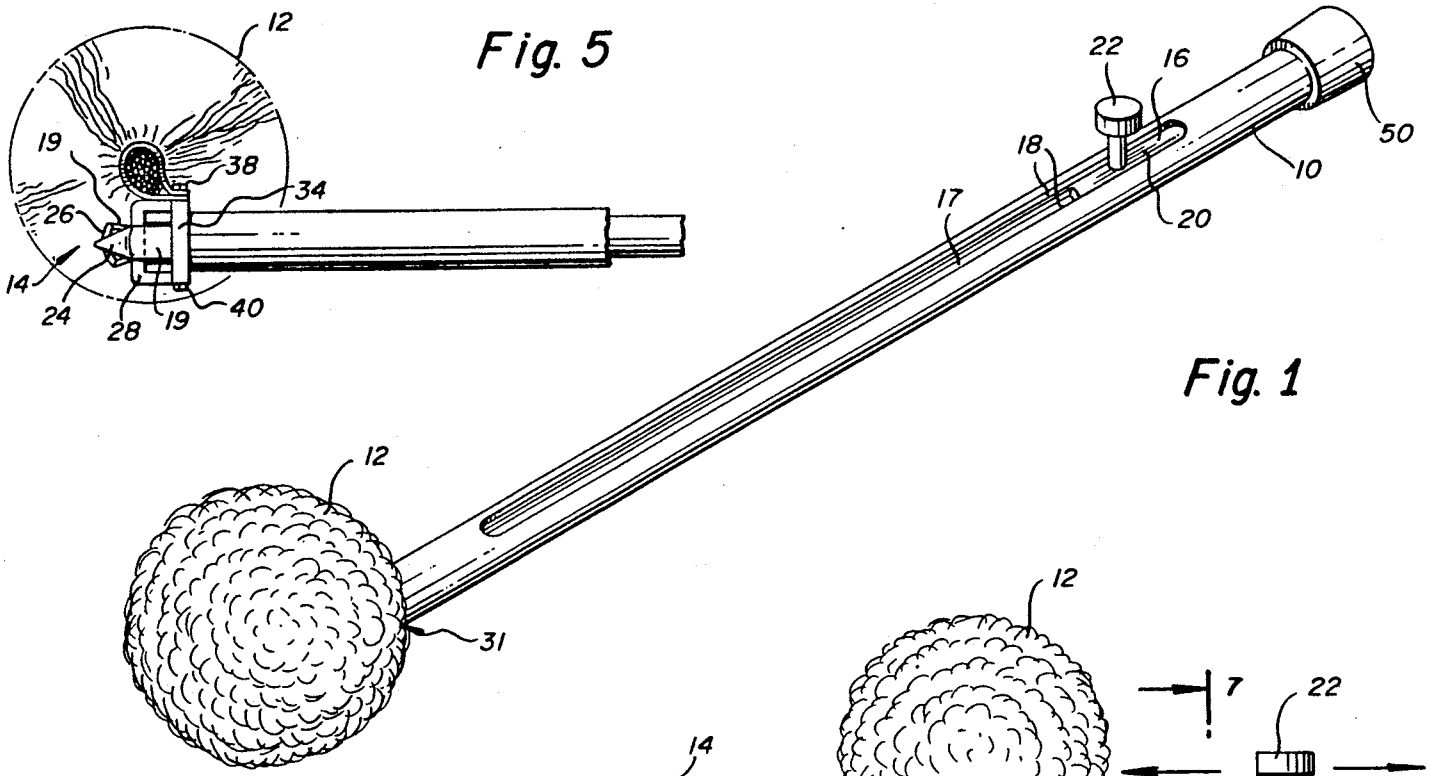
Fig. 1
Fig. 5
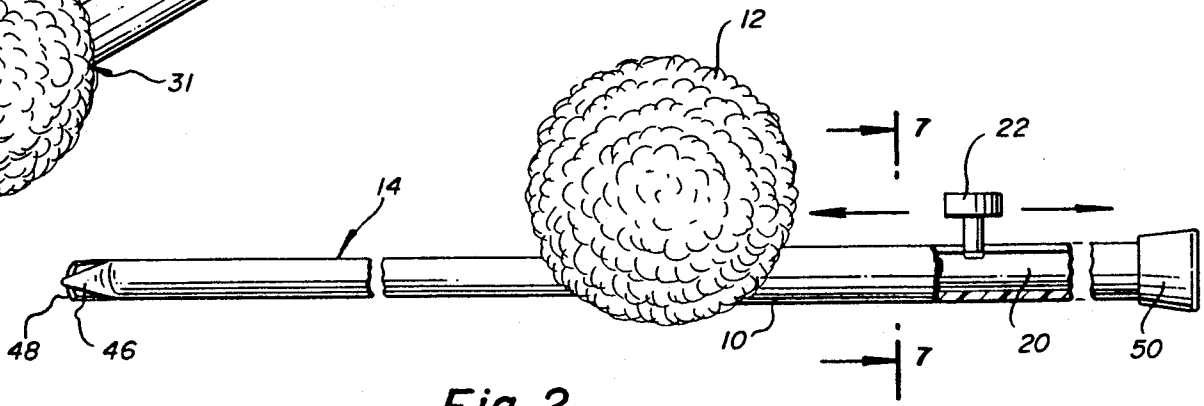
Fig. 2

JANITORIAL BRUSH GRASPING DEVICE

FIELD OF THE INVENTION

This invention relates to an implement used in cleaning restroom surfaces and also includes a grasping device for remotely retrieving articles.

BACKGROUND OF THE INVENTION

Regular cleaning of toilets and urinals is required in order that the devices continue to operate properly. Furthermore, regular bathroom service requires that deodorant blocks and urinal screens have to be moved and replaced from time to time.

People reach new lows in behavior when they enter public restrooms and many have been known to throw undesirable items on the floor, in the urinal, and in the toilet itself. Items such as cigarette butts, beer bottles, plastic tampon containers, dirty diapers, underwear, sanitary napkins, paper towels, entire rolls of tissue paper are just a few of the assortment of items commonly encountered in janitorial work. Then there is also the cigarette filter that sits on top of the water and will not go down the urinal regardless of how many times it is flushed.

With the number of hazardous and life-threatening germs around these days, no one really wants to come into contact with anything that is found in a toilet. Most of the time these items are fished out with whatever happens to be handy, hangers are very popular, in addition to the conventional toilet brush, and when all else fails, the janitor may have to resort to using a glove and actually grasping the item.

In view of the foregoing it can be seen that there is a need for a device which allows safe and effective grasping and removal of a variety of items from toilets and urinals and further includes a brush for cleaning the toilets and urinals.

OBJECTS AND SUMMARY OF THE INVENTION

One of the most important objects of the invention is to provide a restroom implement having a retractable grasping device.

Another object of the invention is to provide a hollow handle for housing a pair of retractable arms to prevent undesirable contact with the grasping arms after use.

Yet another object of the invention is to provide a brush head mounted on the handle for use in cleaning.

Still another object of the invention is to mount the brush head at the side of the brush handle so that the user's view is not obstructed during actuation of the grasping arms.

Yet another object of the invention is to provide a spreading element at the base of the handle which causes said grasping arms to be spread apart a sufficient distance for grasping the desired object.

Still another object of the invention is to provide a push knob mounted to the grasping tongs and extending through the handle wall for remote actuation of the grasping tongs.

In summary, therefore, the invention is directed to a janitorial device which includes a grasping device which is remotely operable from a push rod mounted in the handle of the device. A replaceable cleaning brush is mounted at one end of the handle and is mounted to one side thereof to allow a clear view, when the handle is properly oriented, of the grasping device. The grasping device is spreadable by a spreading member mounted at the end near the brush head. The spreading member allows the grasping arms to be spread a required distance depending on the diameter of the object to be picked up.

The invention will be further described with respect to the following drawings and detailed description.

BRIEF DESCRIPTION OF THE DRAWINGS

FIG. 1 is a perspective view of the handle and brush with the handle in a retracted position;

FIG. 2 shows the grasping device in the extended position relative to the handle;

FIG. 5 is a sectional view of the brush head revealing the connection of the brush to the handle;

DETAILED DESCRIPTION OF THE INVENTION

Figure 3:
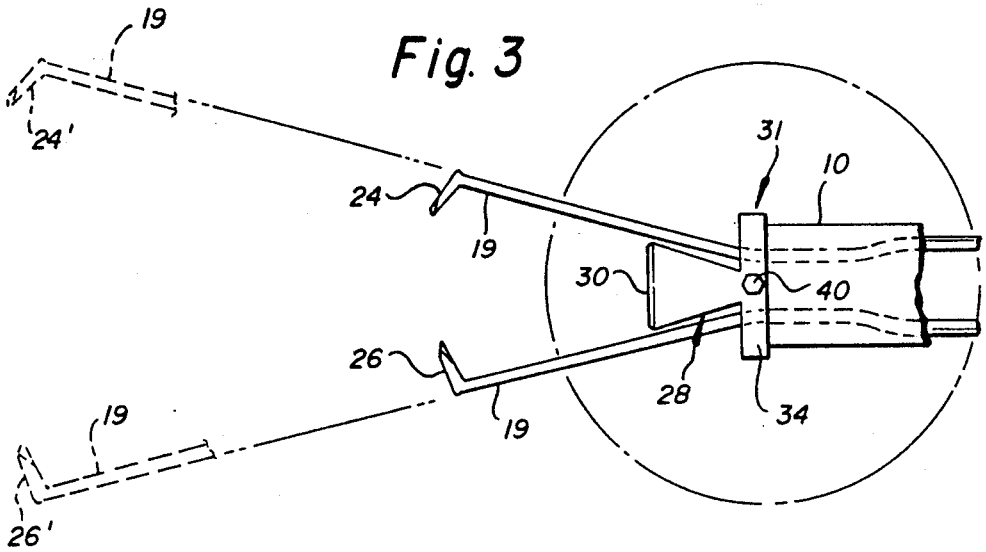
FIG. 3 is a partial view showing the grasping mechanism extended from the handle end.

As shown in FIGS. 1 and 2, the janitorial implement according to the invention includes a hollow handle 10, a brush 12, and a grasping device generally designated by reference numeral 14. Brush 12 is mounted on one end of handle 10. A slot 16 is formed through the outer side wall of handle 10 providing a track 17 between wall edges 18.

In a preferred embodiment of the invention, grasping device 14 includes a pair of cooperating grasping elements 19 which extend from the end of handle 10 to which brush 12 is attached. Grasping elements 19 are preferably integrally connected to a handle extension or rod 20 which is slidably mounted within the hollow interior 21 of handle 10. A push knob 22 is connected to handle extension 20 and extends through slot 16 for moving the handle extension 20 into and out of hollow handle 10.

As shown in FIG. 3, the pair of cooperating grasping elements 19 includes a first tong 24 and a second tong 26. Between tongs 24 and 26, a spreading member 28 is operatively positioned. Spreading member 28 is preferably positioned at the end of handle 10 to which brush 12 is attached and preferably includes a spreader bar 30 for enlarging the distance between tongs 24 and 26. The hidden lines of FIG. 3 illustrate the fully extended position of the tongs which are designated 24', 26'.

Figure 4:
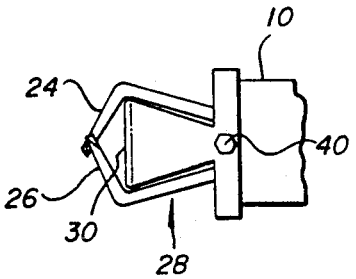
FIG. 4 shows the grasping arms in the retracted position.

FIG. 4 shows the position of spreading member 28 when push knob 22 is fully retracted, (i.e., when the grasping elements are substantially within hollow handle 10). As push rod 22 is operatively moved forward towards the brush 12, tongs 24 and 26, respectively are forced apart by spreader bar 30 which is slightly wider than the space between tongs 24 and 26 when they are retracted within hollow handle 10. The spreader bar 30 maintains tension on the grasping elements 19 even when the elements 19 are fully retracted to keep the elements 19 from sliding out during cleaning with the brush 12.

A brush 12 or any appropriate scrubbing means is connected to the handle 10 to enable the grasping elements 19 to be mounted within hollow handle 10 and to extend from the handle 10 without interference from brush 12. The side mounting of brush 12 on handle 10 also provides improved visibility enabling a user to easily retrieve an object from a toilet or urinal. A preferred method of attaching brush 12 to handle 10 is shown in detail at FIG. 5 wherein the brush is joined to the side 34 of spreading member 28 by a loop 36 formed preferably of flexible plastic material such as nylon fixed to spreading member 28 by pin 38. Pin 38 preferably extends through hollow handle 10 and is secured preferably by a nut 40. The pin 38 and nut 40 allows the brush 12 to be replaced.

The pin 38 or other fastening means which secures brush 12 to side of spreading member 28 should be made out of teflon nylon or other special material that withstands corrosion from the caustic chemicals used to clean toilet bowls. For example, most of available industrial strength toilet bowl cleaners include about 25% hydrogen chloride.

The size of spreading member 28 is such that spreading bar 30 extends across the outer diameter of handle 10. Spreading member 28 further includes a U-shaped member extending from one side of the outer diameter of handle 10 to the other side of the outer diameter.

The preferred embodiment of the implement employs an extension 20 which may be made of plastic material such as polyvinylchloride (PVC).

The retracted position of grasping tongs 24 and 26 is shown in FIG. 4 which additionally shows the structure of the U-shaped spreading member 28. The width of the spreading bar 30 is wider than the width of the grasping elements 19 when they are located within the hollow handle 10 such that it causes grasping tongs 24 and 26 to be spread apart a sufficient distance for grasping the undesirable objects floating in toilets or urinals. The width of spread is relative to the extended length of the grasping elements 19 when they are extended.

Figure 6:
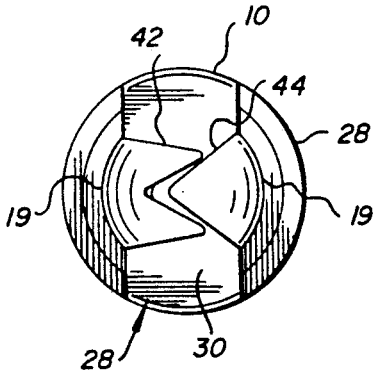
FIG. 6 is an end view showing the spreader bar and teeth.

The two tongs 24, 26 are preferably arced for rigidity. Tongs 24 and 26 may include teeth 42 and 44 formed thereon. These teeth 42 and 44 can be designed and shaped depending upon the type of objects desired to be pulled from toilets or urinals. As shown in FIG. 6, a preferred grasping device would include a tong with large teeth such as depicted by reference 42 and a singular tooth such as depicted by reference 44. With such design, the grasping elements 19 facilitate the removal of both small and large items from toilets and urinals. When picking up small items, it is preferred that handle 10 is rotated so that brush 12 is off to the side of the object to be picked up. With such an operation, the cleaning person using the implement according to the invention would have a better view and thereby make the object easier to retrieve.

Figure 7:
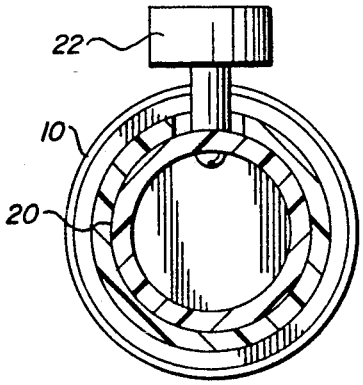
FIG. 7 is a cross-sectional view taken along lines 7—7 of FIG. 2; and, FIG. 8, is a perspective view of another embodiment of the spreader mechanism.

FIG. 7 shows a cross-sectional view taken along lines 7—7 of FIG. 2 revealing the extension member 20 fitting concentrically within the handle 10. Push knob 22 extends through slot 16 and partially through extension 20 as shown in FIG. 7. As a result, push knob 22 is mounted to the cylindrical extension 20 of grasping tongs 24 and 26 and extends through handle 10 for remote actuation of the grasping tongs 24 and 26.

The extension 20 and grasping elements 19 preferably should be formed integrally together and made of one piece. For example, extension rod 20 could be made from a plastic tube approximately ½ inch wide by ⅛ of an inch thick and about 24 inches long. The tube is cut to form the two grasping tongs 24, 26 to a length that is appropriate for grasping items from a toilet bowl or a urinal.

In the preferred embodiment, two small strips of plastic can be attached to handle 10, one strip on each side of the brush clamp to secure the brush and eliminate the possibility of the brush rotating on the handle.

Figure 8:
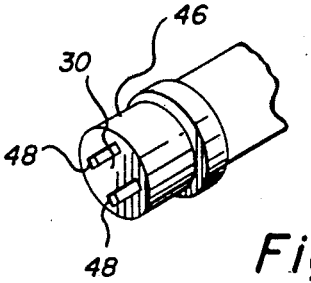

The spreading member 28 may also include a housing 46 having grooves 48 located on either side of the spreader bar 30. As can be seen from FIG. 8, the pair of grooves 48 are formed in spreading member 28 parallel to the spreader bar 30. As a result of this structure, the tongs 24 and 26 are received in grooves 48 providing a guiding surface for separating the tongs.

Handle 10 also includes an end cap 50 which covers any rough edges on the handle end and also prevents water from draining out the handle at the cap end 52.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A janitorial implement comprising:

a) means for forming a handle having a first end and a second end and an outer sidewall and a hollow interior and having cleaning means operatively connected thereto;

b) a pair of cooperating means being extendable from said first end for grasping objects;

c) a handle extension integrally connected to said cooperating means and being slidable within said hollow interior;

d) an operating means connected to said handle extension for moving said handle extension into and out of said hollow interior;

e) spreading means operatively positioned at said first end for enlarging the distance between said pair of cooperating means when said handle extension is moved outwardly from said hollow interior;

f) said handle extension having a longitudinal slot of substantially uniform width when said handle extension is retracted within said hollow interior forming a pair of extension arms;

g) whereby said extension arms diverge when moved outwardly from said hollow interior to enable adjustment of the distance between said pair of cooperating means to enable grasping of different sized objects and said cleaning means is positioned so that viewing of the cooperating means is not obscured during grasping of objects.

2. The janitorial implement as set forth in claim 1, wherein:

a) said cleaning means is removably mounted at said first end of said outer sidewall.

3. The janitorial implement as set forth in claim 1, wherein:

a) said cleaning means is formed of a brush.

4. The janitorial implement as set forth in claim 1, wherein:

a) said side wall includes a slot therein; and, b) said operating means is connected to said handle extension through said slot for moving said handle extension into and out of said hollow handle.

5. The janitorial implement according to claim 1, and wherein:

a) said scrubbing means is operatively mounted on the sidewall of said handle.

6. The janitorial implement according to claim 1, and wherein:

a) said handle extension includes two extension arms; and, b) each said arm has an arced shape for rigidity.

7. The janitorial implement according to claim 1, and wherein:

a) said cooperating means includes teeth.

8. The janitorial implement according to claim 1, and wherein:

a) said cooperating means and said handle extension are integrally formed.

9. The janitorial implement according to claim 1, wherein:

a) said spreading means is wider than said longitudinal slot.

10. A janitorial implement adapted for cleaning restroom fixtures and the like, said janitorial implement comprising:

a) a hollow handle having an outer sidewall and a hollow interior;

b) said handle further having a first end and a second end;

c) a pair of cooperating means operable at said first end for grasping objects;

d) a cleaning means mounted at said first end of said handle; and, e) said cleaning means is fastened to said handle and positioned for operable use at said first end.

11. The janitorial implement as set forth in claim 10, wherein:

a) said cleaning means is held in position by a removable fastening means.

12. The janitorial implement as set forth in claim 11, wherein:

a) said cleaning means is formed of a brush and said fastening means forms a loop of material connected with said first end by a removable pin.

13. The janitorial implement as set forth in claim 11, wherein:

a) said cleaning means is fastened to and extends outwardly from said sidewall of said handle at said first end.

14. The janitorial implement as set forth in claim 10, wherein:

a) a spreading member is connected to said handle at said first end; and, b) said pair of cooperating means is extendable from said first end divergently.

15. The janitorial implement as set forth in claim 14, wherein:

a) said cleaning means is joined to said spreading member.

16. The janitorial implement as set forth in claim 15, wherein:

a) said cooperating means is extendable from said first end when a force is applied at a position along said handle remote from said first end.

17. A janitorial implement adapted for cleaning restroom fixtures and the like, said janitorial implement comprising:

a) a hollow handle having an outer side wall and a hollow interior;

b) said handle further having a first end and a second end;

c) a pair of extendable cooperating elements located adjacent said first end;

d) a cooperating element extending member operably connected to said cooperating elements and located at a position along said handle remote from said first end;

e) a spreading member located adjacent said first end for causing said cooperating elements to diverge when extended from said handle; and, f) a cleaning device joined to said spreading member.

* * * * *